United States Patent [19]

Mason

[11] 4,232,862

[45] Nov. 11, 1980

[54] OBSTACLE SAFETY DEVICE

[76] Inventor: Michael Mason, 604 Primrose La., Schaumberg, Ill. 60194

[21] Appl. No.: 8,683

[22] Filed: Feb. 1, 1979

[51] Int. Cl.[3] ..... A63B 5/02

[52] U.S. Cl. ..... 272/102

[58] Field of Search ..... 272/74, 75, 76, 93, 272/102, 109, 110, 1 R, 28, 39, 85; 116/63 R, 63 P, 173; 273/26 E, 29 A, 95 A, 204; 43/21.2; 119/29

[56] References Cited

U.S. PATENT DOCUMENTS

| | | | |
|---|---|---|---|
| 1,699,308 | 1/1929 | Postings | 119/29 |
| 2,191,253 | 2/1940 | Hanke | 272/102 |
| 2,199,461 | 5/1940 | Jones | 273/95 A |
| 2,333,273 | 11/1943 | Scanlon . | |
| 2,823,038 | 2/1958 | White | 273/26 E X |
| 2,906,507 | 9/1959 | Hodson . | |
| 3,021,101 | 2/1962 | Gliebe | 43/21.2 X |
| 3,119,588 | 1/1964 | Keats . | |
| 3,380,738 | 4/1968 | Papp | 273/26 E |
| 3,455,552 | 7/1969 | Sherwood | 273/26 E |
| 3,732,842 | 5/1973 | Vara . | |
| 3,782,322 | 1/1974 | Wilson . | |
| 3,834,695 | 9/1974 | Boggild et al. | 272/110 |

FOREIGN PATENT DOCUMENTS

| | | | |
|---|---|---|---|
| 542465 | 5/1922 | France | 272/75 |
| 25767 | 11/1907 | United Kingdom | 273/204 |

*Primary Examiner*—Richard J. Apley

*Attorney, Agent, or Firm*—Hill, Van Santen, Steadman, Chiara & Simpson

[57] ABSTRACT

A hurdle obstacle utilized curved bars of selected sizes each supported in the apex of a standard module conical base such that a main portion of the bar extends parallel to the ground for jumping over or moving beneath. One end of the obstacle bar is swivelably engaged in the base by means of a flanged bushing which receives one end of the bar so that upon impact with a user, the safety obstacle device swivels out of the user's path to prevent tripping or other injury.

1 Claim, 4 Drawing Figures

OBSTACLE SAFETY DEVICE

BACKGROUND OF THE INVENTION

1. Field of the Invention

This invention is in the field of recreational and athletic equipment, specifically relating to obstacle devices such as hurdles.

2. Description of the Prior Art

Obstacle devices such as hurdles are well known in the art relating to athletic equipment both on a professional and amateur level. Such devices frequently take the form as disclosed in U.S. Pat. No. 2,191,253 and are generally placed in a running track requiring the runner to jump over a series of such hurdles to complete the race. Although hurdles such as U.S. Pat. No. 2,191,253 are constructed so as to give away slightly when struck by a user who does not cleanly clear the hurdle, such devices are generally rather rigid in construction and quite often do not give away sufficiently to prevent tripping or other injury to the runner. The materials used to construct such hurdles are generally wood and steel, which similarly add to the possibility of injury upon impact. Obstacles such as U.S. Pat. No. 2,191,253 do not afford a device which may be jumped over and moved beneath, because such hurdles are generally constructed by side support means limiting the width of the hurdle. Even the trained athlete faces some probability of injury in using such a hurdle, and younger, amateur users may not be able to utilize such a device at all due to the inherent danger of injury.

Cones of the type commonly used for road safety marking and other similar uses are well known in the art, such as U.S. Pat. Nos. 3,732,842 and 2,333,273. In particular, the device disclosed in U.S. No. Pat. 3,732,842 is heavily constructed and possesses stabilizing features.

SUMMARY OF THE INVENTION

The present invention provides an inexpensive, safe obstacle device which may be utilized by amateur and professional athletes in competition or simply for recreation.

The device consists of a cone-like base which has a circular receptacle at its apex. A curved rod has a radius of curvature such that when one end of the rod is inserted into the receptable in the cone, a longer, main portion of the rod extends parallel to the ground. The main portion of the curved rod extends a sufficient height above the ground to provide an obstacle for jumping over or moving beneath.

The end of the rod extending into the cone is received in a flanged bushing, which has a lower shank portion which extends a sufficient distance into the cone to provide vertical support for the rod. The coefficient of friction between the bushing and the interior of the cone receptacle is such that if and when the horizontal portion of the rod is struck by a user, the rod will swivel in the cone receptacle and move away from the user, thereby preventing tripping or other injury due to impact with the obstacle device. The coefficient of friction is such that the swiveling of the rod in the receptacle will cease before the rod swings into an area which may interfere with an adjacent track running lane.

A plurality of rods having different radii of curvature may be used with the cone base, to provide a series of obstacle devices having incremental heights thereby providing an inexpensive set of hurdles.

DESCRIPTION OF THE PREFERRED EMBODIMENTS

Figure 1:
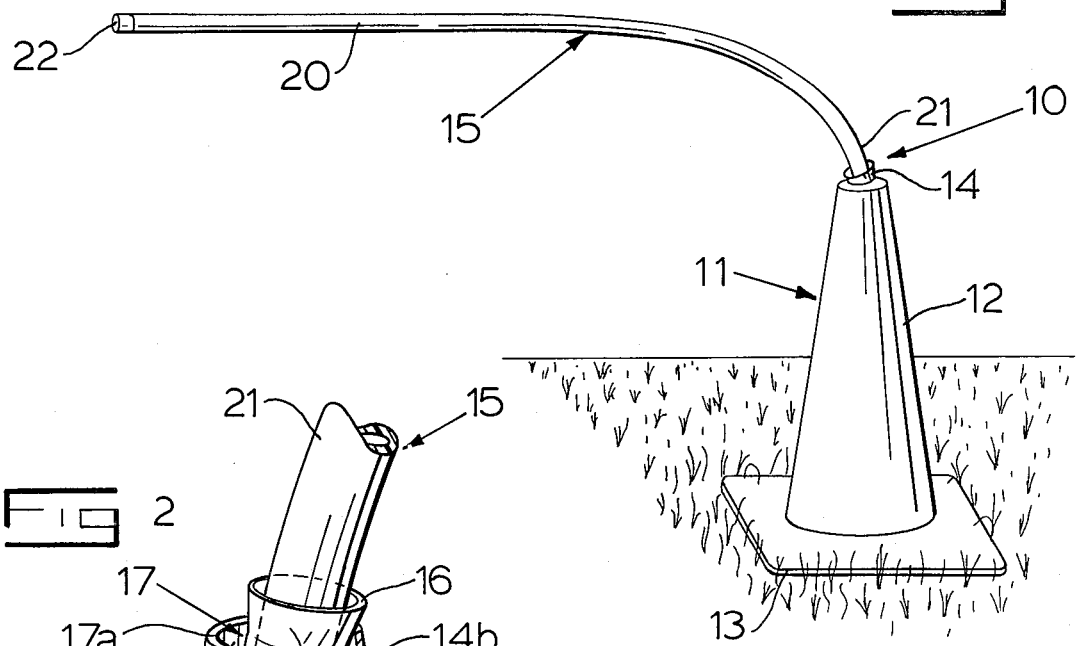
FIG. 1 is a perspective view of a safety obstacle device.

A safety obstacle device is shown generally at 10 in FIG. 1. The device consists generally of a support means 11, a bushing 14 and an obstacle rod 15. The support means 11 consists of a base 13 which rests upon the ground, and a cone-shaped upright portion 12 attached to the base 13.

The rod 15 is curved to divide the rod into two portions, an obstacle portion 20 which extends generally parallel to the ground, and a support portion 21 which extends generally perpendicular to the ground.

The bushing 14 in a generally cylindrical tube which may be closed at one end as at **14*a* and has a flanged lip 16 which surrounds an opening 14*b* through which the upright portion 21 of the rod 15 is inserted. The rod 15 extends into a bore 14*c* of the bushing 14 a sufficient distance so that it is securely seated to prevent disengagement during normal usage. The flanged lip 16 not only provides a degree of radial freedom of movement for the upright portion 21 of the rod 15 about the central axis of the rod-bushing combination but also may be made sufficiently outwardly flaring to provide a seating surface 16*a***.

The bushing 14 extends into a circular receptacle 17 at the apex of the cone 12. The bushing 14 extends a sufficient distance into the cone 12 so as to rest against an interior wall thereof and maintain the portion 20 of the rod 15 generally parallel to the ground. In this regard, the seating surface **16*c* on the flared lip 16 engages the adjoining edges 17*a* of an opening 17 formed in the upper apical extremities of the cone, which opening operates as a socket for receiving the pin represented by the support portion 21**.

A protective cap 22 is disposed at the free end of the rod 15 to prevent abrasions or other injuries should a user come in contact with the end of the rod 15.

The bushing 14 is swivelably engaged in the receptacle 17 such that rotational movement about a generally upright axis corresponding to the vertical axis of the cone 12 is permitted. Should the horizontal portion 20 of the rod 15 be struck by a user attempting to jump over or move beneath the rod 15, the entire rod-bushing assembly will readily swivel in the cone 12 thus giving way to the users impact, and preventing tripping or injury of the user due to contact with the obstacle device. The rod 15 may then be manually replaced in the desired position with great facility. Likelihood of injury occuring in the course of use of the present invention is further lessened by the fact that the support means-rod combination is not immovably affixed to the ground, nor is its construction such that an unusually high impact force is necessary to tip the device over. Under all impact conditions, therefore, it is the device which gives way rather than remaining stable and tripping or injuring the user.

Each support means or cone 11 may be fabricated as a standard module, for example, comprised of molded plastic, or other suitable material. The rod 15 and the bushing 14 may also be formed as portions of hollow plastic tubing, suitably molded and curved, or any other appropriate light-weight material.

Figure 2:
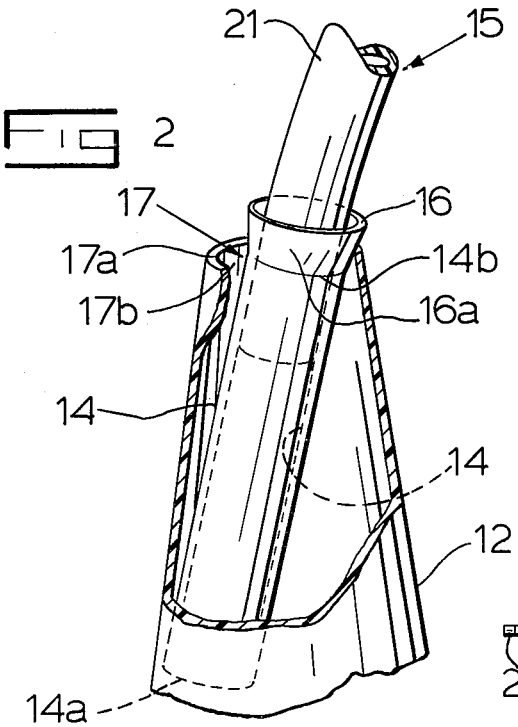
FIG. 2 is an enlarged view, partially broken away, of the apex of the device of FIG. 1.
Figure 3:
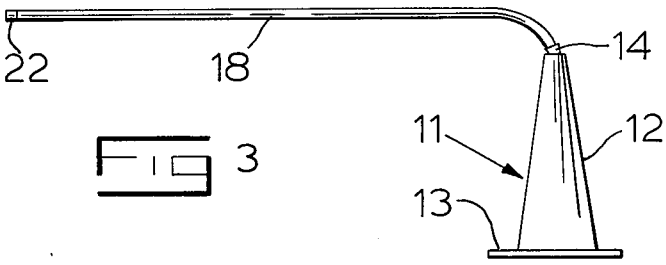
FIG. 3 is a side view of an embodiment of the device of FIG. 1 utilizing a rod having a small radius of curvature.

A number of rods 15 having varying sizes and correspondingly varied radii of curvature may be employed with the same support means 11. A rod 18 having a small radius of curvature is shown in FIG. 3 engaged in the support means 11. The engagement of the rod 18 with the bushing 14 is identical to that shown in FIG. 2 in association with rod 15.

Figure 4:
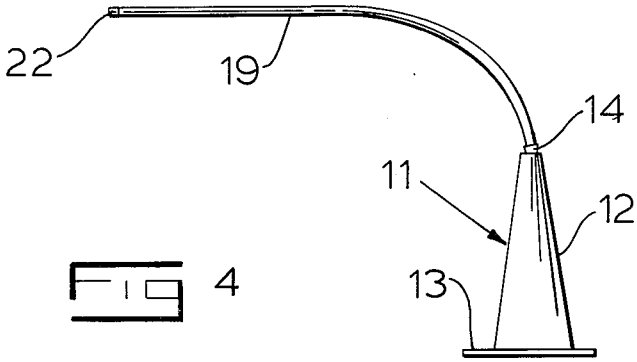
FIG. 4 is a side view of an embodiment of the device of FIG. 1 using a rod with a large radius of curvature.

A rod 19 having a large radius of curvature is shown inserted into the support means 11 in FIG. 4. Again, the rod-bushing engagement is identical to that shown in FIG. 2. It will be noted that if tubing of identical length is utilized to construct the rods of varying curvature such as 18 and 19, that the rods such as 19 having a larger radius of curvature will have a shorter horizontal portion. If it is desired to provide obstacle devices haivng horizontal portions of equal length, longer rods may be used to construct the obstacle devices having greater degrees of curvature, and thus extending a greater height above the ground.

An entire set of hurdles utilizing an identical support means 11 may thus be provided, by constructing a series of curved rods having varying degrees of curvature, such as 15, 18, and 19. All such rods are capped by a protective cap 22 at the free end thereof.

Although various changes and modifications may be apparent to those versed in the art, it is applicant's intention to embody within the patent warranted hereon all such changes and modifications which reasonably come within the scope of applicant's contribution to the art.

I claim as my invention:

1. An obstacle device set comprising:

a cone-shaped support means having an opening in a top thereof;

a plurality of curved obstacle rods each having a different radius of curvature and each having a vertical portion and a horizontal portion; and a flanged bushing for receiving an end of each vertical portion of each said rod, said bushing having a shank portion which is received in said opening in said support means and extends therein a sufficient distance to maintain said horizontal portion of each said rod generally parallel to the ground, said bushing having a coefficient of friction sufficient to allow rotation of said vertical portion of each said rod about a central upright axis of said cone, such that said obstacle rods may be selectively removably engaged in said support means to provide a set of obstacles of varying heights.

* * * * *